US006503674B2

(12) United States Patent
Sirejacob

(10) Patent No.: US 6,503,674 B2
(45) Date of Patent: Jan. 7, 2003

(54) COMPONENT FOR A PRINTER, FAX MACHINE, COPIER OR THE LIKE

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 09/841,204

(22) Filed: Apr. 24, 2001

(65) Prior Publication Data

US 2002/0177058 A1 Nov. 28, 2002

(51) Int. Cl.[7] ..... G03G 15/08; G03G 5/147
(52) U.S. Cl. ..... 430/67; 399/276
(58) Field of Search ..... 399/275, 276; 360/130.24; 430/66, 67

(56) References Cited

U.S. PATENT DOCUMENTS

| | | | | |
|---|---|---|---|---|
| 3,830,656 A | | 8/1974 | Takenaka et al. | 117/212 |
| 3,933,548 A | | 1/1976 | Anderson, Jr. et al. | 156/78 |
| 4,989,044 A | * | 1/1991 | Nishimura et al. | 399/276 |
| 5,023,280 A | | 6/1991 | Haas et al. | 521/106 |
| 5,177,322 A | * | 1/1993 | Nishimura et al. | 360/130.24 |
| 5,855,820 A | | 1/1999 | Chan et al. | 252/511 |
| 6,061,545 A | * | 5/2000 | Cerrah | 399/328 |
| 6,074,791 A | | 6/2000 | Jennings et al. | 430/58.8 |
| 6,117,603 A | * | 9/2000 | Yu et al. | 430/66 |

FOREIGN PATENT DOCUMENTS

| | | | |
|---|---|---|---|
| CA | 2195839 | 1/1997 | B32B/27/20 |
| EP | 0337228 A1 | 3/1989 | C08K/3/04 |
| EP | 0786422 A2 | 3/1997 | B65D/90/46 |

* cited by examiner

*Primary Examiner*—John Goodrow
(74) *Attorney, Agent, or Firm*—Darby & Darby

(57) ABSTRACT

Member for a printer, a fax machine, a copier or a toner cartridge, in which said member has a face in contact with toner particles, said face being provided with a top layer in contact with toner particles, said top layer comprising substantially spherical particles with a Mohs hardness of more than 3 or equal to 3 and an average particle size lower than 100 $\mu$m.

74 Claims, 1 Drawing Sheet

COMPONENT FOR A PRINTER, FAX MACHINE, COPIER OR THE LIKE

PRIOR ART

It has already been suggested to provide members of copier, facsimile machine, printer, such as magnetic drum, doctor blade, scrappers, scraping blade, rollers, photoconductive imaging member, with specific top layer or intermediate layers.

For example U.S. Pat. No. 6,074,791 disclose a photoconductive imaging member comprised of a supporting substrate, a hole blocking layer thereover, a photo generating layer and a charge transport layer.

Tests have shown that the top layer of the members of printer in contact with toner particles has to be accurately selected in order to have the best life time, i.e. the longer working of the printer.

It has now been discovered that by using members provided with a top layer containing spherical particles with a particle size lower than 100 $\mu$m, it was possible to improve the quality of the copies of a copier and the life time of said members. For example, it has been discovered that by using a magnetic drum provided with such a top layer, it was possible to ensure good copies after more than 40,000 copies and even more. It has also been observed that the efficiency of the toner transfer was improved when using member of the invention, especially a magnetic drum of the invention.

BRIEF DESCRIPTION OF THE INVENTION

The invention relates to a member for a printer, a fax machine, a copier or a toner cartridge, in which said member has a face in contact with toner particles, said face being provided with a top layer in contact with toner particles, said cop layer comprising substantially spherical particles with a Mohs hardness of more than 3 or equal to 3, advantageously more than 4, preferably more than 4.5, most preferably comprised however between 3 and 7 and an average particle size lower than 100 $\mu$m, advantageously lower than 50 $\mu$m, preferably lower than 40 $\mu$m.

Substantially spherical particles means in the present specification particles having a spherical shape, a substantially spherical body provided with one or more (for example two) recesses, such a form similar to an apple, particles having an ovoid shape, shape having a ratio volume/surface comprised 1:4.2 and 1:2, etc.

Substantially spherical particles with a Mohs hardness of more than 3 or equal to 3 means substantially spherical particles having as such a Mohs hardness of more than 3 or equal to 3, spherical particles having a core with a Mohs hardness of more than 3 or equal to 3, as well as particles provided with an outer coating having a Mohs hardness of more than 3 or equal to 3. Preferably, the particle as such or its core has a Mohs hardness of more than 3 or equal to 3.

According to an embodiment, at least 50% of the substantially spherical particles with a Mohs hardness of more than 3 or equal to 3 have advantageously a particle size distribution factor at 80% of less than 1. Most preferably the substantially spherical particles with a Mohs hardness of more than 3 or equal to 3 and having a particle size greater than 25 $\mu$m have a distribution factor at 80% lower than 1, preferably lower than 0.8. The distribution factor at 80% is equal to:

$$(\phi_{80\%}-\phi_{20\%})/[(\phi_{80\%}+\phi_{20\%})/2]$$

in which $\phi_{20\%}$ is the maximum diameter of the particles fraction corresponding to 20% by weight of the particles, the particles of said fraction having a diameter or particle size lower than $\phi_{20\%}$ $\phi_{80\%}$ is the maximum diameter of the particles fraction corresponding to 80% by weight of the particles, the particles of said fraction having a diameter or particle size lower than $\phi_{80\%}$ Preferably, at least 50% of the substantially spherical particles with a Mohs hardness of more than 3 or equal to 3 have a particle size distribution factor at 90% of less than 1, advantageously of less than 0.8, preferably of less than 0.5, most preferably of less than 0.3. A small particle size distribution factor means that substantially all the particles have a diameter corresponding substantially to the average diameter. This is advantageous in order to obtain a layer having a substantially constant thickness. Most preferably the substantially spherical particles with a Mohs hardness of more than 3 or equal to 3 and having a particle size greater than 25 $\mu$m have a distribution factor at 90% lower than 1, preferably lower than 0.8, most preferably lower than 0.5, such lower than 0.3.

The distribution factor at 90% is equal to:

$$(\phi_{90\%}-\phi_{10\%})/[(\phi_{90\%}+\phi_{10\%})/2]$$

in which $\phi_{10\%}$ is the maximum diameter of the particles fraction corresponding to 10% by weight of the particles, the particles of said fraction having a diameter or particle size lower than $\phi_{10\%}$ $\phi_{90\%}$ is the maximum diameter of the particles fraction corresponding to 90% by weight of the particles, the particles of said fraction having a diameter or particle size lower than $\phi_{90\%}$.

According to an embodiment, the top layer comprises various different fractions of substantially spherical particles with a Mohs hardness of more than 3 or equal to 3. For example, the top layer comprises substantially spherical particles with a bi-modal distribution. The top layer comprises for example a mixture of substantially spherical particles, a first fraction of which having an average diameter greater than 30 $\mu$m, and a second fraction of which having an average diameter lower than 20 $\mu$m, the weight ratio first fraction/second fraction being comprised between 1:20 and 20:1, advantageously between 1:10 and 10:1, preferably between 1:4 and 4:1. The presence of the two fractions can be seen for example when plotting a particle size curve, due to the presence of two visible peaks corresponding substantially to the average particle size of the second fraction and the average particle size of the first fraction.

When using a mixture of larger particles (such as particles with a particle size greater than 20 $\mu$m, preferably with an average particle size greater than about 30 $\mu$m), it is advantageous to add to the mixture some smaller particles (such as particles with a particle size lower than about 10 $\mu$m) so as to fill the inter space formed between the larger particles. This is particularly advantageous when the support or substrate to be provided with a top layer is not plane (is curved, for example cylindrical).

Possibly, the top layer can contain particles with a Mohs hardness of less than 3, for example substantially spherical particles with a Mohs hardness of less than 3, fibres, filaments, fabrics, metallic powders (copper, zinc, tin, iron, aluminium, etc.), metallic fibres, carbon particles, carbon black, carbon fibres, etc. Preferably, the top layer is however free or substantially free of particles with a Mohs hardness of less than 2.

According to a detail of an embodiment, the top layer comprising substantially spherical particles with a Mohs hardness of more than 3 or equal to 3 is a layer comprising a binder for binding the spherical particles in the layer, said layer having a top face at which a portion of substantially spherical particles with a Mohs hardness of more than 3 or equal to 3 is provided with a binder coating with a thickness of less than 50 μm, advantageously lower than 30 μm, preferably lower than 20 μm, most preferably of less than 10 μm.

Preferably, the top layer comprising substantially spherical particles with a Mohs hardness of more than 3 or equal to 3 is a layer comprising a binder for binding the substantially spherical particles in the layer, said layer having a top face at which a portion of spherical particles with a Mohs hardness of more than 3 or equal to 3 is substantially free of binder.

The binder is advantageously a synthetic binder, advantageously a binder being substantially stable at temperature above 50° C., advantageously above 800° C. preferably above 100° C., for example stable at temperature comprised between 130° C. and 300° C., or even more. Such binder is for example polyurethane, thermoplastic polyurethane, a polyester, a polyester polyurethane, silane, a fluorosilane, a fluorosiloxane, polysiloxane, polypropylene, polyethylene, epoxy resin, rubber, teflon, PVC, polyphenylene oxide, polysulfone, polyamide, polyimide polymer, etc. and mixtures thereof. The binder can have a foam structure, but has preferably no foam structure or substantially no foam structure. Advantageously the resin has some electrical conductive properties and is preferably considered as electrically conductive.

The top layer has advantageously a resistance against abrasion measured by the ASTM-1938 abrasion test of less than 0.1 g. The preparation of polyurethane films, bands or layers (conductive or not) can be made by using the methods disclosed in U.S. Pat. Nos. 3,933,5448; 3,830,656; 5,855,820; EP 0 786 422 and/or EP 0 337 228, the content of which is incorporated herewith by reference. When the layer has to be non conductive, no conductive materials are added in the process of U.S. Pat. Nos. 3,933,5448; 3,830,656; 5,855;820 EP 0 786 422. Advantageously, the polyurethane is however a thermoplastic polyurethane.

For having an easy preparation of the top layer, the binder is advantageously selected form the group comprising curable binders, such as heat curable binders, radiation curable binder, etc. The top layer is advantageously prepared from a solution or dispersion containing the curable binder, said solution or dispersion being an organic solvent based solution or dispersion, but preferably an aqueous solution or dispersion. The dispersion is advantageously free of enmulgators or emulsifiers.

The top layer has advantageously an electrical surface resistivity of less than $10^{13}\Omega$ per square, preferably lower than $10^{5}\Omega$ per square, most preferably lower than $10^{3}\Omega$ per square, for example $10^{2}\Omega$ per square, $10\Omega$ per square or even less.

The top layer is advantageously attached or bond to a substrate or support with interposition of one or more intermediate layers, such as an elastic layer, a conductive layer, a layer with a high electrical resistance, such a layer having for example a surface electrical resistance of more than $10^{10}\Omega$ per square, advantageously more than $10^{12}\Omega$ per square, preferably more than $10^{13}\Omega$ per square, most preferably more than $10^{14}\Omega$ per square.

The top layer has for example a thickness of less than 500 μm, advantageously of less than 200 μm, preferably of less than 100 μm, such as less than 50 μm, for example 40 μm, 30 μm, 20 μm. Preferably, the top layer has a minimum thickness of about 10 μm.

According to a preferred embodiment, the top layer has an average maximum thickness corresponding substantially to the average particle size of the spherical particles with a Mohs hardness of more than 3 or equal to 3 or an average thickness corresponding substantially to the maximum particle size of the substantially spherical particles.

The top layer is advantageously electrically conductive. For example, the spherical particles are electrically conductive. For example, the spherical particles are provided with an electrically conductive coating having a thickness of less than 50 μm, advantageously of less than 30 μm, preferably less than 20 μm, most preferably less than 10 μm, such as less than 5 μm, for example 2 μm or even less (1 μm or even less). The substantially spherical particles can possibly be only partly coated.

According to a specific embodiment, the top layer comprises binder and spherical particles with a Mohs hardness of more than 3 or equal to 3 and an average particle size lower than 100 μm, the volume ratio binder/substantially spherical particles with a Mohs hardness of more than 3 or equal to 3 and an average particle size lower than 100 μm being lower than 1, advantageously lower than 0.7, preferably lower than 0.5.

For example, the weight content of substantially spherical particles with a Mohs hardness of more than 3 or equal to 3 and with a particle size of less than 100 μm in the top layer is comprised between 1% and 30%, advantageously between 1.5% and 20%, preferably between 2% and 15%, most preferably between 5% and 12%.

The spherical particles have an apparent density which can be higher than 1, lower than 1 or possibly equal to about 1.

The top, laxer comprises advantageously a binder and spherical particles with a Mohs hardness of more than 3 or equal to 3 and an average particle size lower than 100 μm, said the spherical particles having an apparent density lower than, higher than or equal to the density of the binder.

The member of the invention is advantageously selected from the group consisting of a photoconductive imaging member, a doctor blade, a scraping blade, a roller, a magnetic drum, an OPC, a wiper blade, etc.

Examples of spherical particles adapted to be used in the member of the invention are spherical glass particles or beads, alumina particles, quartz particles, particles covered with a layer having a Mohs hardness of more than 3 or equal to 3, for example spherical plastic particles provided with an outer coatings having a hardness of more than 3 or equal to 3, spherical glass or siliceous particles provided with a silane or fluorosilane coating. Examples of suitable particles are particles used in the manufacture of recording magnetic tape or support, such as particles of calcium carbonate, for example prepared by precipitation. Particles suitable to be used are rounded particles, the mechanical rounding being possibly a natural rounding due to the sea.

The particles can be hollow particles (so as to decrease the density of the particles), filled with a gas or possibly filled with a material, such a resin, etc.) or common spherical particles (not hollow).

The member of the invention can possibly be only partly coated, or can be coated with a top layer having a variable thickness.

The invention relates also to a machine selected from the group consisting of a copier, facsimile machine, printer, laser printer and toner cartridges, said machine comprising at least a face intended to be in contact with toner particles, said face being provided with a top layer in contact with toner particles, said top layer comprising substantially spherical particles with a Mohs hardness of more than 3 or equal to 3 and an average particle size lower than 100 μm.

The machine of the invention comprises preferably one or more members of the invention as disclosed here before in the present specification.

The invention further relates to a support to be attached to a member of a printer, a fax machine, a copier or a toner cartridge, in which said support has a first face intended to be attached to said member and a second face opposite to said first face and intended to be in contact with toner particles, said second face being provided with a top layer in contact with toner particles, said top layer comprising substantially spherical particles with a Mohs hardness of more than 3 or equal to 3, advantageously higher than 4, preferably higher than 4.5, most preferably comprised between 3 and 7, and an average particle size lower than 100 μm, advantageously lower than 50 μm, preferably lower than about 30 μm. Possibly, the support is the top layer. However, preferably, the support comprises a substrate supporting the top layer. The top layer of the substrate is preferably a top layer as disclosed for the member of the invention.

The support is advantageously a support to be attached, for example to be glued on a member selected from the group consisting of a photoconductive imagine member, a doctor blade, a scraping blade or element, a roller, a magnetic drum.

The first face is advantageously provided with glue, said glue being preferably protected by a siliconized paper or sheet, or any other material which can be removed from the support before and/or during its gluing on an element of a copier, printer, faximile machine, laser printer, etc.

The invention still further relates to a printing process using toner particles and using a machine of the invention, i.e. a machine comprising a member of the invention. The printing process in which toner particles are transferred on a member selected from the group consisting of photoconductive imaging member and magnetic drum, has the improvement that toner particles are transferred on a top face of said member, said top face being provided with a top layer in contact with toner particles, said top layer comprising substantially spherical particles with a Mohs hardness of more than 3 or equal to 3, advantageously more than 4, preferably more than 5, and an average particle size lower than 100 μm, advantageously lower than 50 μm.

It has also been observed that when using a magnetic drum provided with a top layer of the invention, the life time of the doctor blade, OPC and wiper blade was increased. The wearing of the doctor blade, wiper blade and OPC was reduced.

The top layer in said process is advantageously of the type disclosed in the member of the invention.

DESCRIPTION OF PREFERRED EMBODIMENTS

Example 1

Figure 1:
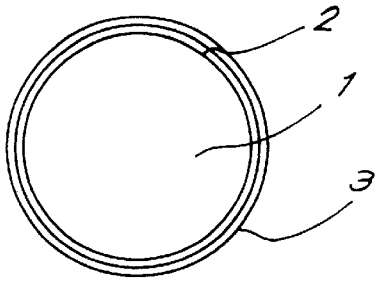
FIG. 1 is a schematic cross section view of a magnetic drum of a toner cartridge of a copier or laser printer.

The drum of FIG. 1 comprises a cylindrical support 1 for example an aluminium support;

a layer 2 made of conductive material and binder, said layer covering the support 1, and a top layer comprising spherical particles having a particle size lower than 100 μm and a Mohs hardness of more than 3 or equal to 3.

The top layer has a thickness of about 20–50 μm.

The top layer was prepared by mixing an aqueous dispersion of a polyurethane-polyester with various particles.

Figure 5:
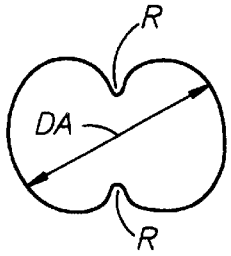
FIG. 5 is an enlarged view of a specific particles.

The particles used for the different preparations are:

particles A: solid soda-lime glass beads coated with silver, the silver content being equal to about 8–10% of the weight of the glass bead, said coated glass beads having an average particle size of 35 μm and a size distribution factor at 90% of about 0.5. The apparent density of the particles is about 1.3 g/cm$^3$ (density of about 2.7 g/cm$^3$), while the powder resistivity is about 1.2 mΩ/cm. The Mohs hardness of the glass beads is equal to about 5.

particles B: solid soda-lime glass beads coated with silver, the silver content being equal to about 15–20% of the weight of the glass bead, said coated glass beads having an average particle size of 35 μm and a size distribution factor at 90% of about 0.5. The apparent density of the particles is about 1.4 g/cm$^3$, while the powder resistivity is about 1.2 mΩ/cm. The Mohs hardness of the glass beads is equal to about 5.

particles C: hollow borosilicate glass with an average particle size of about 15 μm, said particles having a silver content of about 33%. The particle density is about 1.1 g/cm$^3$.

particles D: glass spherical particles with an average particle size of about 10 μm and a distribution factor at 90% of about 2.

particles E: glass spherical particles with an average particle size of about 10 μm and a distribution factor at 90% of about 1.

particles F: hollow borosilicate glass particles with a average diameter of about 10 μm and a distribution factor at 90% of about 2.

particles G: carbon black with a particle size of about 2 μm.

particles H: calcium carbonate particles (precipitated calcium carbonate) with recesses R at the top and bottom apexes (apple form—see FIG. 5), said particles having an average size DA of about 5 μm.

In said preparation, the amount of particles added to the polyurethane-polyester dispersion was comprised between 5% and 25% of the weight of polyester polyurethane present in the aqueous dispersion. After mixing, the dispersion was applied on the substrate, and was thereafter dried and cured at 150° C.

The following table gives the total content TC of particles (% by weight with respect to the weight of the resin after drying and curing), the type of particles TP (for mixture the percentage of the various particles in the mixture is indicated). The thickness TT of the layer is expressed in μm.

| top layer | TT μm | TC (% of the resin weight) | TP |
|---|---|---|---|
| 1 | 40 | 10% | A |
| 2 | 30 | 10% | 50% A + 50% C |
| 3 | 50 | 15% | B |
| 4 | 30 | 7% | 75% A + 25% D |
| 5 | 30 | 5% | 75% A + 25% E |
| 6 | 40 | 10% | 50% A + 40% D + 10% G |
| 7 | 60 | 20% | 90% D + 10% G |
| 8 | 40 | 10% | 75% A + 25% H |
| 9 | 20 | 10% | C |
| 10 | 30 | 15% | 80% F + 10% G + 10% H |
| 11 | 40 | 10% | 25% A + 75% H |
| 12 | 80 | 35% | A |

Figure 3:
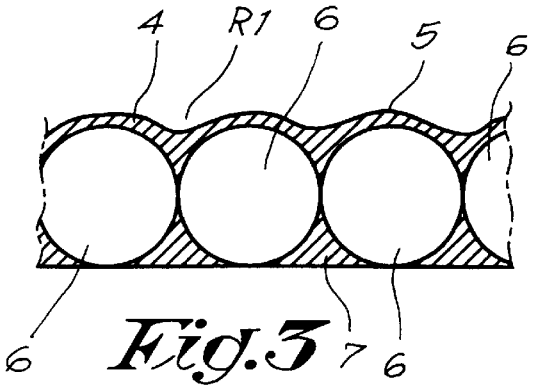
FIG. 3 is a cross section view of a tape intended to be attached on a member of a copier.
Figure 4:
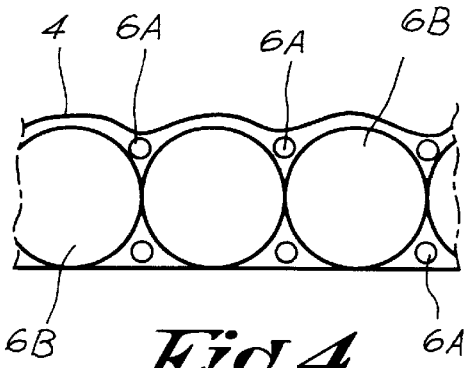
FIG. 4 is an enlarged view of a portion of a top layer of another magnetic drum.

After curing, the top layer as shown in FIGS. 3 and 4 had some recesses R1 defined between the particles 6 along the top face 5 and/or had some particles 6 coated with a very thin resin layer 4 (less than 10 μm). The particles are bound together by the resin 7. The recesses R1 are greater when only large particles are used. When using a mixture of larger particles and small particles (bi modal distribution, such as in top layers 2, 4 and 5), smaller particles 6A flow between the space formed between the large particles 6B. The smaller particles have advantageously a density lower than the density of the large particles. The recesses R1 have for example a depth lower than 5 μm, advantageously lower than 2 μm.

The top layers containing particles A,B,C and G are electrically conductive layer.

In FIG. 4, the amount of resin used was sufficient so that the thickness of the top layer corresponds substantially to the average particle size of the larger particles.

After placing the drum in a toner cartridge and after placing the toner cartridge in a copier, it appears that good copies could be obtained after more than 20,000 copies.

Example 2

Figure 2:
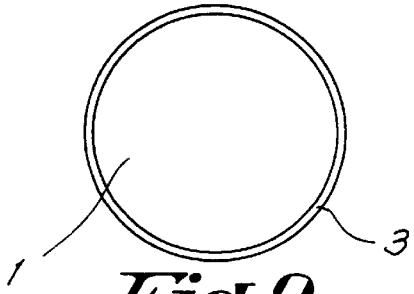
FIG. 2 is an enlarged view of a portion of the top layer of the magnetic drum.

Example 1 was repeated, except that the drum was not provided with an intermediate layer (FIG. 2), i.e. the top layer 3 was directly applied on the substrate 1.

Example 3

Example 1 was repeated, except that various polymer solutions were used instead of a polyurethane dispersion. The polymer of the solution was polysiloxane, polypropylene, epoxy resin, etc. An appropriate solvent was used for ensuring an appropriate coating.

Example 4

Example 1 was repeated, except that the drum was first wetted with the aqueous dispersion and the wetted drum was contacted with particles so as to fix them at the surface of the layer. In this embodiment, at least a portion of the face of the larger particles adjacent to the top face are not coated.

Example 5

Example 4 was repeated, except that a curable glue was applied on the drum.

Example 6

Example 1 was repeated except that some carbon fibres were added for ensuring an electrical conductivity when the particles are not conductive as such.

Figure 6:
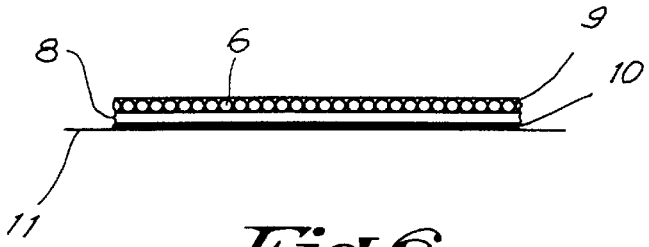
FIG. 6 is a schematic cross section view of a tape.

FIG. 6 is a schematic view of a tape 8 provided with a top layer 9 containing particles with a Mohs resistance of more than 3 or equal to 3, with a glue layer 10 and a siliconized paper 11.

Figure 7:
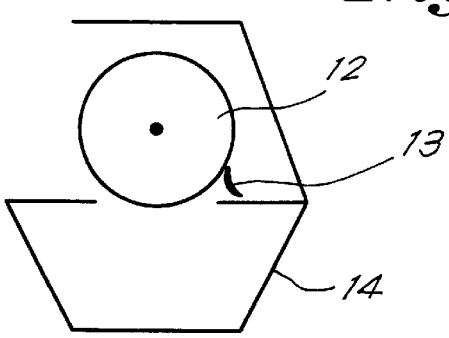
FIG. 7 is a schematic view of a toner cartridge of the invention.

FIG. 7 is a schematic view of a toner cartridge provided with a magnetic drum 12 with a top layer containing conductive particles with a Mohs hardness of about 5 and a doctor blade 13 advantageously provided with a top layer contacting the drum 12 with interposition, of toner particles. The toner cartridge comprises a container 14 with an opening 15 for the passage of toner towards the magnetic drum.

The toner cartridge was placed in a known copier for making photocopies.

It has been observed that when using a magnetic drum provided with a top layer of the invention, the wear of the doctor blade was reduced even if the doctor blade was not provided with a top layer of the invention. When using such a doctor blade, 60,000 to 100,000 copies of good quality could be printed without replacement of the doctor blade or the magnetic drum. When using a doctor blade provided with a top layer, the wear resistance of the doctor blade was still increased, whereby the number of high quality copies was more than 100,000.

What I claim is:

1. A member for a printer, a fax machine, a copier or a toner cartridge, in which said member has a face in contact with toner particles, said face being provided with a top layer in contact with toner particles, said top layer having a thickness of less than about 50 μm comprising substantially spherical particles with a Mohs hardness between 3 and 7, and an average particle size comprised between 10 and 50 μm, wherein said substantially spherical particles with a Mohs hardness between 3 and 7 consist of a first fraction of particles with a particle size greater than the average particle size and a second fraction of particles with a particle size lower than the average particle size, and wherein at least 50% by weight of the first fraction of particles with a Mohs hardness between 3 and 7 has a particle size distribution factor at 80% of less than 1.

2. The member of claim 1, in which at least 50% by weight of the substantially spherical particles of the first fraction have a particle size distribution factor at 90% of less than 1.

3. The member of claim 1, in which at least 50% by weight of the substantially spherical particles of the first fraction have a particle size distribution factor at 90% of less than 0.8.

4. The member of claim 1, in which at least 50% by weight of the substantially spherical particles of the first fraction have a particle size distribution factor at 90% of less than 0.5.

5. The member of claim 1, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is provided with a binder outer coating of less than 10 μm.

6. The member of claim 1, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is substantially free of binder along said top face.

7. The member of claim 1, in which the top layer has an average maximum thickness corresponding substantially to the average particle size of the spherical particles with a Mohs hardness between 3 and 7.

8. The member of claim 1, in which the top layer is electrically conductive.

9. The member of claim 1, in which the top layer comprises substantially spherical particles which are electrically conductive.

10. The member of claim 1, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 1.

11. The member of claim 1, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.7.

12. The member of claim 1, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.5.

13. The member of claim 1, in which the top layer comprises binder and spherical particles with a Mohs hardness of 3 to 7, an average particle size lower than 50 $\mu$m, and an apparent density lower than the density of the binder.

14. The member of claim 1, in which the top layer comprises binder and spherical particles with a Mohs hardness of 3 to 7, an average particle size lower than 50 $\mu$m, and an apparent density higher than the density of the binder.

15. The member of claim 1, in which the top layer comprises binder and spherical particles with a Mohs hardness of 3 to 7, an average particle size lower than 50 $\mu$m, and an apparent density substantially equal to the density of the binder.

16. The member of claim 1, in which the top layer comprises a binder selected from the group consisting of polyurethane, polyurethane polyester, polyester, fluoro resin, epoxy, polysiloxane, silane, silicone, and mixtures thereof.

17. The member of claim 1, in which at least 50% by weight of the particles present in the top layer are substantially spherical particles with a Mohs hardness of 3 to 7.

18. The member of claim 1, said member being a photoconductive imaging member.

19. The member of claim 1, said member being a doctor blade.

20. The member of claim 1, said member being a scraping blade.

21. The member of claim 1, said member being a roller.

22. The member of claim 1, said member being a magnetic drum.

23. A machine selected from the group consisting of a copier, facsimile machine, printer, laser printer and toner cartridge, said machine comprising a face intended to be in contact with toner particles, said face being provided with a top layer in contact with toner particles, said top layer having a thickness of less than about 50 $\mu$m and comprising substantially spherical particles with a Mohs hardness between 3 and 7, and an average particle size comprised between 10 and 50 $\mu$m, wherein said substantially spherical particles with a Mohs hardness between 3 and 7 consist of a first fraction of particles with a particle size greater than the average particle size and a second fraction of particles with a particle size lower than the average particle size, and wherein at least 50% by weight of the first fraction of particles with a Mohs hardness between 3 and 7 has a particle size distribution factor at 80% of less than 1.

24. The machine of claim 23, in which at least 50% by weight of the substantially spherical particles of the first fraction have a particle size distribution factor at 90% of less than 1.

25. The machine of claim 23, in which at least 50% by weight of the substantially spherical particles of the first fraction have a particle size distribution factor at 90% of less than 0.8.

26. The machine of claim 23, in which at least 50% by weight of the substantially spherical particles of the first fraction have a particle size distribution factor at 90% of less than 0.5.

27. The machine of claim 23, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is provided with a binder outer coating of less than 10 $\mu$m.

28. The machine of claim 23, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is substantially free of binder.

29. The machine of claim 23, in which the top layer has an average maximum thickness corresponding substantially to the average particle size of the spherical particles with a Mohs hardness of 3 to 7.

30. The machine of claim 23, in which the top layer has an average maximum thickness corresponding substantially to the maximum particle size of the spherical particles with a Mohs hardness of 3 to 7.

31. The machine of claim 23, in which the top layer is conductive.

32. The machine of claim 23, in which the top layer comprises substantially spherical particles which are electrically conductive.

33. The machine of claim 23, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 1.

34. The machine of claim 23, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.7.

35. The machine of claim 23, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.5.

36. The machine of claim 23, in which the top layer comprises binder and spherical particles with a Mohs hardness of 3 to 7, an average particle size lower than 50 $\mu$m, and an apparent density lower than the density of the binder.

37. The machine of claim 23, in which the top layer comprises binder and spherical particles with a Mohs hardness of 3 to 7, an average particle size lower than 50 μm, and an apparent density substantially equal to the density of the binder.

38. The machine of claim 23, in which the top layer comprises binder and spherical particles with a Mohs hardness of 3 to 7, an average particle size lower than 50 μm, and an apparent density higher than the density of the binder.

39. The machine of claim 23, in which said member being a photoconductive imaging member.

40. The machine of claim 23, in which said member being a doctor blade.

41. The machine of claim 23, in which said member being a scraping blade.

42. The machine of claim 23, in which said member being a roller.

43. The machine of claim 23, which comprises at least two members, a first being from the group consisting of a photoconductive imaging member and magnetic drum, while the other is selected from the group consisting of a doctor blade and a scraping element.

44. A support to be attached to a member of a printer, a fax machine, a copier or a toner cartridge, in which said support has a first face intended to be attached to said member and a second face opposite to said first face and intended to be in contact with toner particles, said second face being provided with a top layer intended to be in contact with toner particles, said top layer with a thickness of less than about 50 μm comprising substantially spherical particles with a Mohs hardness between 3 and 7, and an average particle size comprised between 10 and 50 μm, wherein said substantially spherical particles with a Mohs hardness between 3 and 7 consist of a first fraction of particles with a particle size greater than the average particle size and a second fraction of particles with a particle size lower than the average particle size, and wherein at least 50% by weight of the first fraction of particles with a Mohs hardness between 3 and 7 has a particle size distribution factor at 80% of less than 1.

45. The support of claim 44, in which at least 50% by weight of the substantially spherical particles of the first fraction have a particle size distribution factor at 90% of less than 1.

46. The support of claim 44, in which at least 50% by weight of the substantially spherical particles of the first fraction have a particle size distribution factor at 90% of less than 0.8.

47. The support of claim 44, in which at least 50% by weight of the substantially spherical particles of the first fraction have a particle size distribution factor at 90% of less than 0.5.

48. The support of claim 44, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is substantially free of binder along said top face.

49. The support of claim 44, in which in which the top layer has an average maximum thickness corresponding substantially to the average particle size of the spherical particles with a Mohs hardness between 3 and 7.

50. The support of claim 44, in which the top layer is electrically conductive.

51. The support of claim 44, in which the top layer comprises substantially spherical particles which are electrically conductive.

52. The support of claim 44, in which the top layer comprises binder and spherical particles with a Mohs hardness between 3 and 7, and an average particle size lower than 50 μm, the volume ratio binder/spherical particles with a Mohs hardness of 3 to 7 and an average particle size lower than 50 μm being lower than 1.

53. The support of claim 44, in which the top layer comprises binder and spherical particles with a Mohs hardness between 3 and 7, and an average particle size lower than 50 μm, the volume ratio binder/spherical particles with a Mohs hardness of 3 to 7 and an average particle size lower than 50 μm being lower than 0.7.

54. The support of claim 44, in which the top layer comprises binder and spherical particles with a Mohs hardness between 3 and 7, and an average particle size lower than 50 μm, the volume ratio binder/spherical particles with a Mohs hardness of 3 to 7 and an average particle size lower than 50 μm being lower than 0.5.

55. The support of claim 44, in which the top layer comprises binder and spherical particles with a Mohs hardness of 3 to 7, an average particle size lower than 50 μm, and an apparent density lower than the density of the binder.

56. The support of claim 44, in which the top layer comprises binder and spherical particles with a Mohs hardness of 3 to 7, an average particle size lower than 50 μm, and an apparent density higher than the density of the binder.

57. The support of claim 44, in which the top layer comprises binder and spherical particles with a Mohs hardness of 3 to 7, an average particle size lower than 50 μm, and an apparent density substantially equal to the density of the binder.

58. The support of claim 44, in which the first face is provided with glue.

59. In a printing process in which toner particles are transferred on a member selected from the group consisting of a photoconductive imaging member and a magnetic drum, said process having the improvement that toner particles are transferred on a top face of said member, said top face being provided with a top layer in contact with the toner particles, said top layer having a thickness of less than about 50 μm and comprising substantially spherical particles with a Mohs hardness between 3 and 7, and an average particle size comprised between 10 and 50 μm, wherein said substantially spherical particles with a Mohs hardness between 3 and 7 consist of a first fraction of particles with a particle size greater than the average particle size and a second fraction of particles with a particle size lower than the average particle size, and wherein at least 50% by weight of the first fraction of particles with a Mohs hardness between 3 and 7 has a particle size distribution factor at 80% of less than 1.

60. The process of claim 59, in which at least 50% by weight of the substantially spherical particles of the first fraction have a particle size distribution factor at 90% of less than 1.

61. The process of claim 59, in which at least 50% by weight of the substantially spherical particles of the first fraction have a particle size distribution factor at 90% of less than 0.8.

62. The process of claim 59, in which at least 50% by weight of the substantially spherical particles of the first fraction have a particle size distribution factor at 90% of less than 0.5.

63. The process of claim 59, in which the top layer comprising substantially spherical particles with a Mohs hardness between 3 and 7 is a layer comprising a binder for binding the spherical particles in the layer, said layer having a top face at which a portion of spherical particles with a Mohs hardness between 3 and 7 is substantially free of binder along said top face.

64. The process of claim 59, in which the top layer has an average maximum thickness corresponding substantially to the average particle size of the spherical particles with a Mohs hardness between 3 and 7.

65. The process of claim 59, in which the top layer is conductive.

66. The process of claim 59, in which the top layer comprises substantially spherical particles which are electrically conductive.

67. The process of claim 59, in which the layer comprises an electrically conductive coating.

68. The process of claim 59, in which the layer comprises a metal conductive coating.

69. The process of claim 59, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 1.

70. The process of claim 59, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.7.

71. The process of claim 59, in which the top layer comprises binder and spherical particles with a Mohs hardness between 3 and 7, and an average particle size lower than 50 $\mu$m, the volume ratio binder/spherical particles with a Mohs hardness of 3 to 7 and an average particle size lower than 50 $\mu$m being lower than 0.5.

72. The process of claim 59, in which the top layer comprises binder and spherical particles with a Mohs hardness of 3 to 7, an average particle size lower than 50 $\mu$m, and an apparent density lower than the density of the binder.

73. The process of claim 59, in which the top layer comprises binder and spherical particles with a Mohs hardness of 3 to 7, an average particle size lower than 50 $\mu$m, and an apparent density higher than the density of the binder.

74. The process of claim 59, in which the top layer comprises binder and spherical particles with a Mohs hardness of 3 to 7, an average particle size lower than 50 $\mu$m, and an apparent density substantially equal to the density of the binder.

* * * * *